US006955028B1

(12) United States Patent
Dunaway

(10) Patent No.: US 6,955,028 B1
(45) Date of Patent: Oct. 18, 2005

(54) FOOD CONTAINER AND METHODS OF FORMING AND USING THEREOF

(76) Inventor: Lendy Dunaway, 4636 Spyglass Dr., Dallas, TX (US) 75287

( * ) Notice: Subject to any disclaimer, the term of this patent is extended or adjusted under 35 U.S.C. 154(b) by 0 days.

(21) Appl. No.: 10/760,600

(22) Filed: Jan. 20, 2004

Related U.S. Application Data

(62) Division of application No. 09/898,732, filed on Jul. 3, 2001, now Pat. No. 6,723,360.

(51) Int. Cl.[7] ..... B65B 3/02

(52) U.S. Cl. ..... 53/452; 53/485; 206/430; 426/120

(58) Field of Search ..... 53/452; 206/112, 206/115, 120, 131, 394, 397, 216–218, 430–431, 206/503, 509, 541

(56) References Cited

U.S. PATENT DOCUMENTS

| | | | | | |
|---|---|---|---|---|---|
| 880,082 | A | * | 2/1908 | Kendrick | 215/6 |
| 1,064,442 | A | | 6/1913 | Cadigan | |
| 2,909,304 | A | | 10/1959 | Powell | |
| 3,144,152 | A | * | 8/1964 | Kopp | 215/6 |
| 3,485,416 | A | * | 12/1969 | Fohrman | 222/142.1 |
| 4,444,324 | A | * | 4/1984 | Grenell | 215/6 |
| 4,830,273 | A | * | 5/1989 | Kalberer et al. | 229/123.1 |
| 5,203,137 | A | * | 4/1993 | Tsukada et al. | 53/409 |
| 5,279,841 | A | * | 1/1994 | Yu | 426/131 |
| 5,493,845 | A | * | 2/1996 | Adolf et al. | 53/410 |
| 5,535,889 | A | | 7/1996 | Lin | |
| 5,588,561 | A | | 12/1996 | Ness | |
| 5,630,523 | A | * | 5/1997 | Wright | 220/23.83 |
| 5,786,010 | A | * | 7/1998 | Yannuzzi, Jr. | 426/107 |
| RE35,976 | E | * | 12/1998 | Gasparrini et al. | 206/209 |
| 5,945,145 | A | | 8/1999 | Narsutis et al. | |
| 6,092,717 | A | | 7/2000 | Lowry | |
| 6,158,623 | A | | 12/2000 | Benavides et al. | |
| 6,264,068 | B1 | | 7/2001 | Ours et al. | |
| 6,295,792 | B1 | * | 10/2001 | Linner | 53/452 |
| 6,398,071 | B1 | | 6/2002 | Fellers | |

* cited by examiner

*Primary Examiner*—John Paradiso
(74) *Attorney, Agent, or Firm*—Slater & Matsil, L.L.P.

(57) ABSTRACT

A method of forming a multiple food product container for dispensing one food product from at or near one region of the container, and dispensing another food product at or near the other region of the container, is provided. In the method the two containers are coupled together (i.e., permanently or separably coupled). A preferred embodiment comprises an upper food compartment, a lower food compartment, wherein a top of the lower food compartment is coupled to a bottom of the upper food compartment, a resealable opening disposed at a top of the first food compartment, a resealable second opening disposed proximate a bottom of the second food compartment, a first food disposed in the upper food compartment, and a second food disposed in the lower food compartment.

21 Claims, 5 Drawing Sheets

FOOD CONTAINER AND METHODS OF FORMING AND USING THEREOF

This application is a divisional of patent application Ser. No. 09/898,732, now U.S. Pat. No. 6,723,360, entitled "Food Container and Methods of Forming and Using Thereof," filed on Jul. 3, 2001, which application is incorporated herein by reference.

TECHNICAL FIELD

The present invention relates generally to the containing and dispensing of food products, and more particularly to a food container holding a combination of food products, and methods of forming and using thereof.

BACKGROUND

Prior art food products, particularly snack products, are packaged in a wide variety of containers, including cans, bags, boxes and so forth. Generally, each of these containers shares a common attribute in that the food product contained therein is dispensed from the top of the container. This attribute generally precludes the ability to combine food products such that they may be conveniently dispensed from a single container and eaten together.

One of the attempts to package multiple ready-to-eat products in a single container is a lunch or snack kit that has various food products, such as crackers, meats, cheeses or spreads. Generally, each of these packages is intended for a single use because the packages are not re-sealable. The food products generally require two hands to eat (e.g., to put the cheese or meat on a cracker) and therefore require a flat surface or other stable support for them to be consumed conveniently. Each package is generally disposed of after the single use, even if the consumer has not eaten all of the food products contained in the package, thereby possibly wasting food and some of the consumer's money.

Another example of a multiple food product container is a tray containing chips and dip. This type of container generally has the same problems as the lunch kits discussed above. This container also is intended as a single use food dispenser. Both of the food products are accessed from the top of the tray, and once the container is opened, if all the chips are not consumed in a single sitting, there is no convenient mechanism for resealing and saving the chips for a future snack or meal. The same problem may also apply to the dip; once the dip container is opened, the dip is generally consumed in a single sitting because the dip container may not be re-sealable. In addition, the chips and dip may be subject to spillage if the consumer attempts to hold the tray with one hand and eat with the other, because a tray typically is a difficult type of container to hold in one hand relative to other types of containers such as canisters. Therefore a flat surface or other stable support is generally used to support the tray while consuming the food products contained in the tray.

In summary, there are several disadvantages to prior art food containers. For single-food-product containers that provide top access to the contents, such as a bag of potato chips, a consumer typically reaches into the bag and gets oils or seasonings or the like on the consumer's hand. This requires extra care by the consumer to not spread the oils and the like to the local surroundings, and generally requires some type of cleanup afterward.

As for canister type single product containers, in which the consumer generally tips the canister to dispense product into the consumer's hand, there is generally a tendency for excess salt, spices, food product fragments, and other undesirable debris to spill out, along with the desired food product. The consumer is then faced with the options of consuming the debris or of disposing of it in some way.

With respect to multiple-food-product containers, such containers in prior art generally are intended for a single use only, and the food products are packaged in a one-size-fits-all portion size. Generally, if a consumer does not want to eat the entire portion, the consumer either throws the remainder away, or eats more than intended so as not to waste food or money. In addition, prior art containers generally do not provide any options for re-sealing so that excess food may be consumed at a later time, or transported easily without the risk of spillage or contamination.

Furthermore, prior art multiple-food-product containers generally require some type of stationary or stable surface to enable the user to conveniently consume the food products. Prior art containers therefore are not conducive to dispensing multiple food products for consumption while walking or during other activities where a stable surface is not readily available.

SUMMARY OF THE INVENTION

These and other problems are generally solved or circumvented, and technical advantages are generally achieved, by preferred embodiments of the present invention in which a multiple-food-product container dispenses one food product from at or near one region of the container, and dispenses another food product at or near the other region of the container.

In accordance with another preferred embodiment of the present invention, a container for dispensing multiple food products comprises a first compartment for holding a first food product, the first compartment having a first access region and a first coupling region opposite the first access region, the first access region having a first opening providing access to an interior of the first compartment, and a second compartment for holding a second food product, the second compartment having a second access region and a second coupling region opposite the second access region, the second coupling region coupled to the first coupling region of the first compartment, the second access region having a second opening providing access to an interior of the second compartment. The first food product may be dispensed through the first opening at the first access region of the container, and the second food product may be dispensed through the second opening at the second access region of the container.

In accordance with another preferred embodiment of the present invention, a container for dispensing multiple food products comprises a first food chamber, a second food chamber, the second food chamber coupled to the first chamber, a first opening at a first region of the first food chamber, the first region opposite the second food chamber, a first moveable lid sealing the first opening, a second opening at a second region of the second food chamber, the second region opposite the first food chamber, a flap sealing the second opening, a first food disposed in the first chamber, and a second food disposed in the second chamber.

In accordance with yet another preferred embodiment of the present invention, a container for dispensing multiple food products comprises an upper food compartment, a lower food compartment, wherein a top of the lower food compartment is coupled to a bottom of the upper food compartment, a resealable opening disposed at a top of the first food compartment, a resealable second opening disposed proximate a bottom of the second food compartment, a first food disposed in the upper food compartment, and a second food disposed in the lower food compartment.

In accordance with a preferred embodiment of the present invention, a method of forming a multiple-food container comprises forming a first section having a first compartment, and having a first opening at a top of the first section, filling the first compartment with a first food, sealing the first opening at the top of the first compartment with a removable lid, forming a second section having a second compartment, forming a second opening having a moveable seal proximate a bottom of the second compartment, filling the second compartment with a second food, sealing the second compartment; and coupling a top of the second section to a bottom of the first section.

In accordance with another preferred embodiment of the present invention, a method of dispensing multiple food products from a single container comprises moving a seal to expose a first opening to a first chamber at a top of the container, moving a seal to expose a second opening to a second chamber proximate a bottom of the container, extracting a first portion of a first food product from the second chamber through the second opening, and extracting a second portion of a second food product from the first chamber through the first opening.

One advantage of a preferred embodiment of the present invention is that it allows for the convenient dispensing of multiple food products from a single container. The multiple food products, such as chips and dip may be easily combined together and consumed with one hand accessing the food products and the other hand holding the container. Alternatively, if the container is otherwise stabilized, only a single hand may be used to access the food products.

Another advantage of a preferred embodiment of the present invention is that it is re-sealable, and leftover food product may be saved for consumption at a later time instead of being thrown away. Thus neither the food nor the consumer's money is wasted. In addition, the container may be resealed and transported easily without the risk of spilling the contents. The container may appeal to a wider range of consumers that want the flexibility of deciding how much to eat at one time, and who want to consume the food products intermittently.

Another advantage of a preferred embodiment of the present invention is that dispensing a food such as chips from the bottom of the container is generally a cleaner method than dispensing the food from the top of the container. In this preferred embodiment only the tips of the fingers are exposed to the oily surface of the chips and inside of the container, instead of the entire hand. In addition, because the container does not require tipping to dispense chips, undesirable debris, such as excess salt, is not spilled out of the container.

Another advantage of a preferred embodiment of the present invention is that it may hold two food products that can be combined before eating, such as chips and dip, or two food products that are not combined before eating. For example, a single container may hold a drink in the upper compartment, and nuts or chips in the lower compartment. The container may have a size and shape that fits in a standard cup holder, without the risk of the food product spilling out.

Another advantage of a preferred embodiment of the present invention is that the container may be made reasonably crushproof and durable, and thus no additional or special precautions are necessary for storing, packing or carrying the food contents.

Another advantage of a preferred embodiment of the present invention is that the container may be made modular, such that separate components containing different types of food products may be connected together to form the complete container. For example, with a chip and dip food combination, the consumer may choose from a selection of upper components containing different types of dips, and also choose from a selection of lower components containing different types of chips. The two components may then be combined together to form the whole container. Therefore the manufacturer is not required to make and the seller is not required to stock every possible combination to appeal to all consumer tastes. The individual consumer may decide at the point of purchase which specific combination of food products is desired at that time. Alternatively, multiple lower components may be stacked together with a top component for a multiple chip container. In addition, multiple top compartments may be stacked together, although generally only the food product in the uppermost compartment may be accessed at one time.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments primarily in a specific context, namely the dispensing of multiple types of snack foods from a single container. The invention may also be applied, however, to dispensing other types of products from access points proximate opposite regions of a single container, and in particular to dispensing combinable products from a single container. Generally as used herein with respect to a region of a container, the word "proximate" means at that region, or near that region relative to the opposite region of the container.

With reference now to FIGS. 1–4, there are shown various perspective and cutaway views of a preferred embodiment container, canister 100 having two chambers or compartments for dispensing two different types of combinable food products, in this example chips and dip. Lower compartment 102 contains a stackable solid food product such as chips, and upper compartment 104 contains a fluid or conformable food product such as dip. The dip may be any type of conformable food product, such as salsa, hot sauce, onion dip, cheese dip, bean dip, and the like. The chips may be any type of reasonably uniform or regular layered product, such as pressed potato chips, crackers, flat tostado or tortilla chips, or the like. The chips are not required to be flat; as long as a chip may be slid by another chip as it is pulled from the container. For example, saddle-shaped chips may be slid lengthwise with respect to each other. In addition, as a chip is dispensed, the chips above it may be shifted up slightly to ease the extraction of the chip from the container.

Container 100 is preferably primarily made of sturdy paper or cardboard lined with a metallic foil, although it may be made of other types of materials, such as plastic, wood or metal. Container 100 has a generally cylindrical shape to allow for easy grasping with one hand. The lower compartment 102 is provided with second opening 110 proximate the bottom of canister 100.

Figure 1:
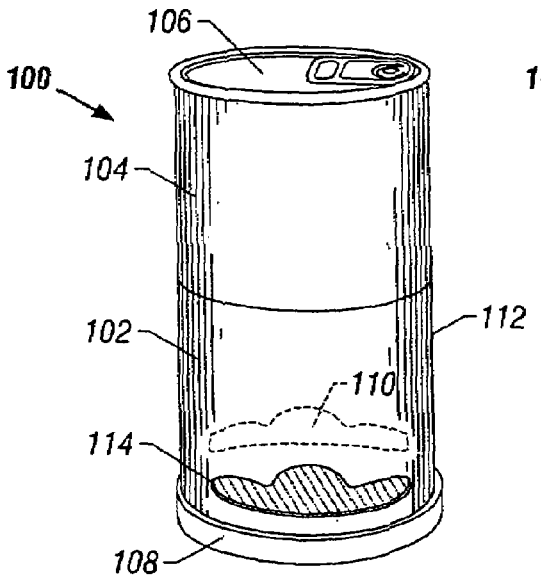
FIG. 1 is a perspective view of a food container with upper and lower closed compartments.
Figure 2:
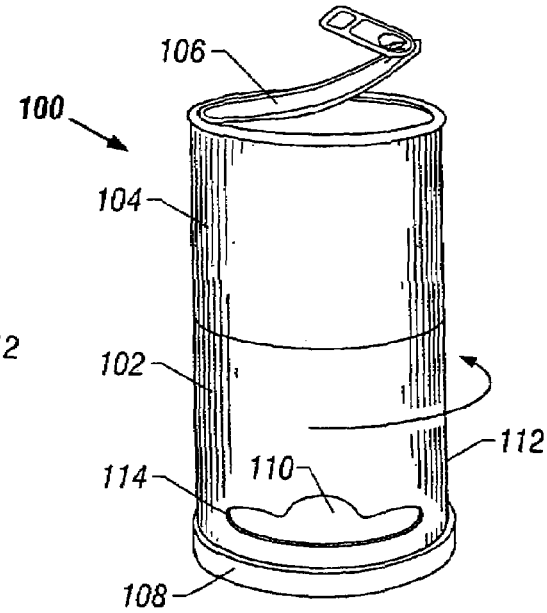
FIG. 2 is a perspective view of the food container of FIG. 1 with the compartments opened.
Figure 4:
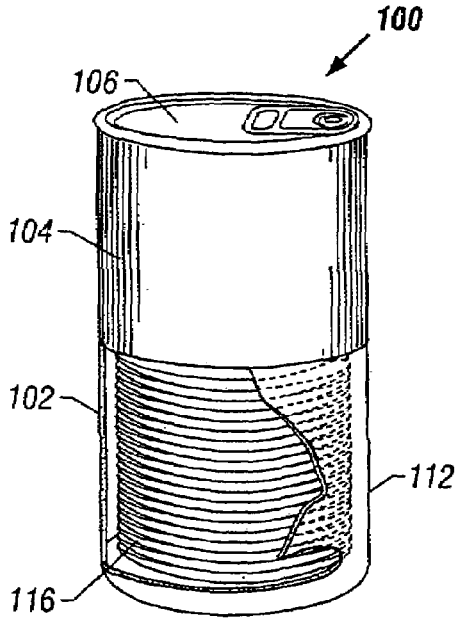
FIG. 4 is a cutaway perspective view of the food container of FIG. 1 showing the food in the lower compartment.

In addition lower compartment 102 has a sliding or rotative sleeve 112 wrapped around its circumference, with a hole 114 in it that is made to align with second opening 110. Container 100 is initially provided to the consumer with second opening 110 sealed, either by hole 114 not being aligned with second opening 110, or with an additional removable seal or flap. The consumer may remove the additional seal and rotate the sleeve until hole 114 is aligned with second opening 110, as shown in FIG. 2. The second opening 110 is sized and shaped appropriately to allow the consumer to gain access to the interior of compartment 102 (with thumb and forefinger, for example) and slip a chip out of the bottom or near the bottom of the stack. FIG. 4 is a cutaway perspective view of container 100 showing chips 116 stacked inside compartment 102. The second opening may be of any shape, such as round, oblong, rectangular, and the like. The shape of the second opening preferably is dependent on the shape of the food product contained in the lower compartment, and may provide extra room to permit a consumer's fingers to grasp a chip and pull it through the second opening. The hole in the sleeve is preferably the same shape and size as the second opening, but it may be smaller or larger, or may have a different shape altogether, depending on the application. Excess areas in the bottom of container 100 may receive excess salt and other debris so that there is minimal spillage. The dispensing of chips to the second opening 110 proximate the bottom of compartment 102 frees up the top of canister 100, allowing a second product to be dispensed from the top of canister 100.

Accordingly, attached to the top of upper compartment 104 is removable metal lid 106 of the type commonly used in snack product containers, although it may be made of other types of materials. Container 100 is initially provided to the consumer with lid 106 attached in order to preserve the freshness of the dip contained in compartment 104, and with a resealing plastic lid 108 attached to the top or bottom of container 100. The consumer may remove lid 106 to access the dip, and attach resealing lid to the bottom of container 100 for storage. Because the other product, e.g., the chips, is accessed from proximate the bottom of the container, essentially the entire top surface of container 100 may be used to provide access to the dip in compartment 104.

Figure 3:
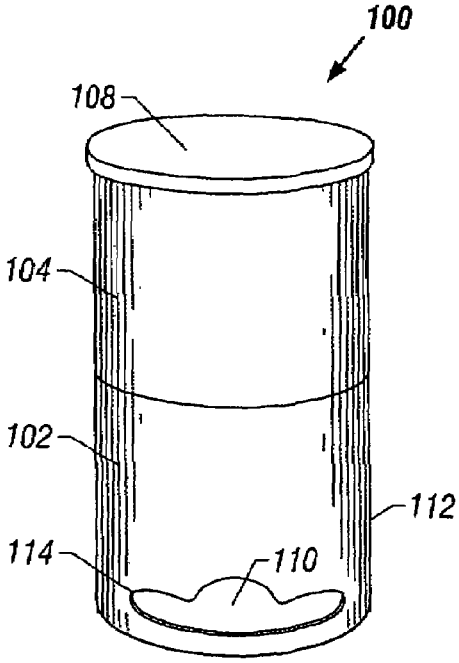
FIG. 3 is a perspective view of the food container of FIG. 1 with the top compartment resealed.

Once the consumer opens both compartments, the container 100 may be held in one hand while the chips are extracted with the other and dipped into the dip in the top of the can. The consumer may retrieve a chip from chip stack 116 in lower compartment 102, and dip it in the dip contained in upper compartment 104. When the consumer is finished eating, both compartments may be resealed to keep the food contents fresh and in the compartments. Once resealed, container 100 may be easily transported without special considerations. After the consumer is finished eating a portion of the dip, the consumer may place resealing lid 108 on the top of container 100 to reseal upper compartment 104, as shown in FIG. 3. Lower compartment 102 may be resealed by rotating the rotative sleeve so that second opening 110 and hole 114 do not overlap.

Container 100 provides the convenience of multiple or combination product dispensing from a single container, provides resealability, and frees the consumer from having to eat the food products while stationary or while using a stable surface. The consumer may eat the product while moving about, and the container is easily passed and shared among a group. Container 100 may be manufactured or used by the consumer as disposable or reusable. Also, container 100 may be delivered filled with food products, or empty so that it may be filled by the consumer or a reseller.

As will be discussed in more detail below, there are many options for the types of foods that may be stored in the two compartments. For example, upper compartment 104 may contain a beverage, and lower compartment 102 may contain a non-chip food product, such as pepperoni slices, candy, nuts, or any type of modular, pellet or small bite-size food product.

Figure 5:
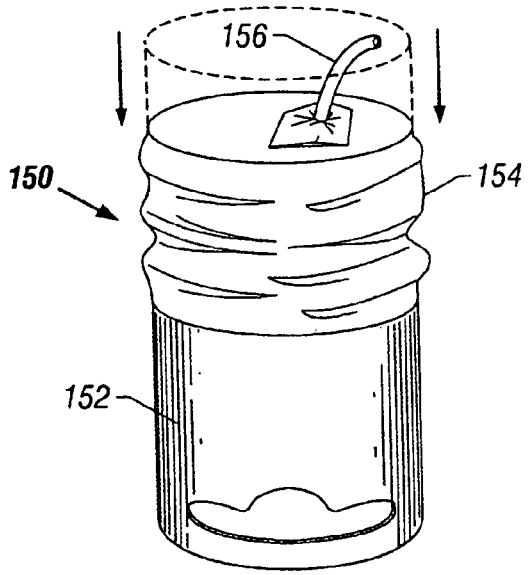
FIG. 5 is a perspective view of a food container with a compressible top compartment for containing a liquid.

Referring now to FIG. 5, there is shown container 150, which comprises a similar lower compartment as that of the container in FIGS. 1–4. Upper compartment 154, however, provides an alternative embodiment for dispensing a liquid or semi-liquid food product, such as hot sauce. Upper compartment 154 has a flexible, collapsible accordion-like plastic shell and a spout 156. Instead of dipping a chip from the lower compartment 152, it would be held under spout 156 and upper compartment 154 compressed to dispense hot sauce onto the chip. Alternatively, the liquid food product may be a beverage that can be sipped from spout or straw 156. In this case the upper compartment 154 does not need to be collapsible, although it may still be.

Alternatively, the upper and lower compartments may be switched if the spout is designed such that it comes out the side of the compartment. In this way, a consumer may dispense chips from the top compartment and squeeze hot sauce out of the bottom compartment through the spout.

Figure 6A:
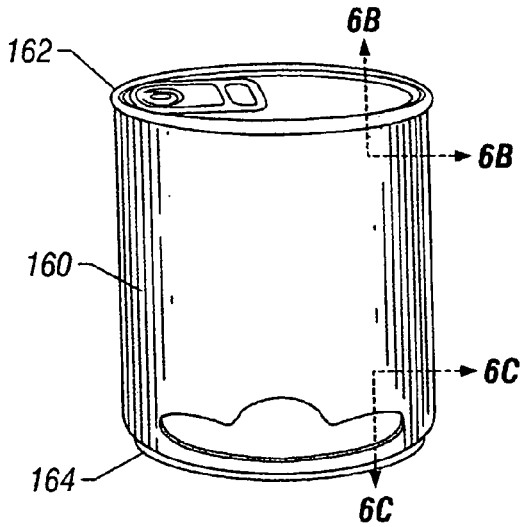
FIG. 6A is a perspective view of a modular component for a food container.
Figure 6B:
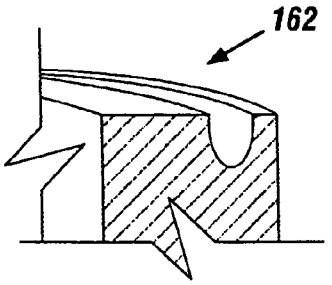
FIGS. 6B & 6C are cross-sectional views of the interlocking portions of the modular component of FIG. 6A.
Figure 6C:
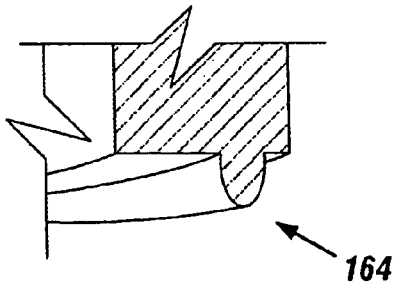

Referring now to FIG. 6A, there is shown a modularized component 160 for a modularized container system. The separate compartments may be modularized so that different products may be chosen by the consumer and snapped together to form a single container with multiple products tailored to the consumer's choice. Alternatively, the modular compartments may be assembled by the manufacturer or a seller. As shown FIG. 6A, modular compartment 160 has bottom ridge 164 which is made to mate with a top channel 162 on another modular compartment. Alternatively, the ridge may be on the top and the channel may be on the bottom. FIGS. 6B and 6C show detailed cross-sections of the channel 162 and ridge 164, respectively. The compartments may be connected together in many ways. For example, they may be snapped together temporarily by the consumer, or bonded together permanently by the manufacturer or seller. The connectors could also include magnets, Velcro or other known fasteners.

In one embodiment, different compartments may be snapped together to form a single container. Lower compartments may contain different types of chips or snack products, and top compartments may contain different types of dip or beverages, so that the consumer may select the specific snack and dip/beverage combination. Alternatively, one consumer may use twice as many chips per serving of dip as another consumer. The consumer may save the dip compartment and dispose of the first the chip compartment so that another chip compartment may be snapped to the bottom of the dip compartment for efficient use of the food products. As another alternative, two or more snack compartments may be snapped together in a stack to the bottom of a dip compartment.

Figure 7:
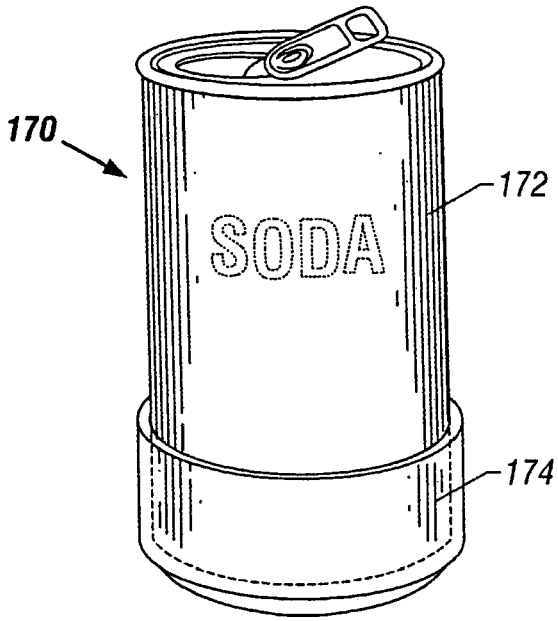
FIG. 7 is a perspective view of a modular adapter for combining a standard size container with other modular components.

Referring now to FIG. 7, there is shown upper compartment 170, which may comprise standard soda can 172 inserted into modular adapter 174. Modular adaptor 174 is designed so that it may snap together with the top of a lower modular compartment. Alternatively, the adapter may be made to hold any type of beverage container, such as a standard glass or plastic bottle. The adapter may be available as a separate product, or may be molded onto certain beverage containers and sold in combination with or sold separately from the other modular compartments. The adapter may be reused by the consumer. Alternatively, the adapter may be formed on a lower compartment, and it may be sold prefilled with chips or empty. The consumer would then fill it with chips if desired, and choose the beverage of choice from the whole array of available 12 oz. cans, for example.

Figure 8:
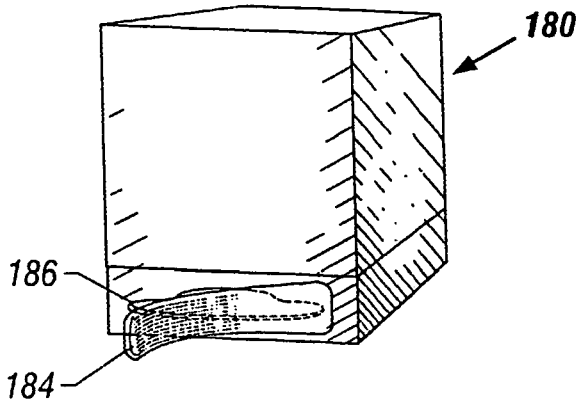
FIG. 8 is a perspective view of an alternate embodiment container with a rectangular shape.
Figure 10:
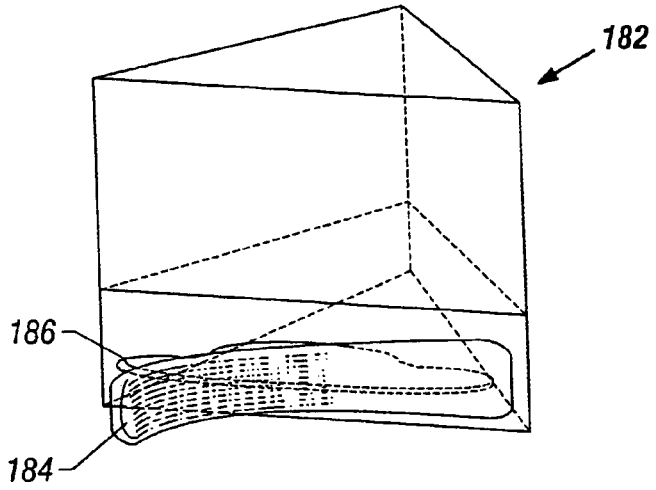
FIG. 10 is a perspective view of an alternate embodiment container with a triangular shape.

FIGS. 8 & 10 show alternative embodiments of the container in shapes other than cylindrical, and alternative embodiments for the lower compartment seal. FIG. 8 illustrates a rectangular shaped container 180 and FIG. 10 illustrates a triangular shaped container 182, although many other shapes for the container are possible. If the seal that covers the second opening in the bottom portion of these containers is a sleeve, the sleeve may be made of a very flexible yet strong material, such as Mylar, that would be able to slide and rotate around corners. The corners are preferably rounded somewhat to accommodate the sliding of the sleeve.

As depicted in FIGS. 8 & 10, there is a moveable peel-back flap or tab 184 shown across second opening 186. Tab 184 may be hinged, and may snap shut for resealing, such that a rotating sleeve is not needed. Alternatively, tab 184 may be a type of non-permanent tape, although it may be subject to the effect of the food oils.

Figure 9A:
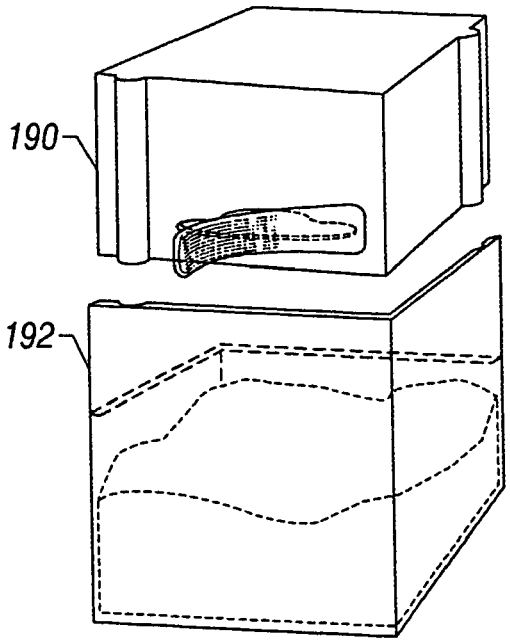
FIG. 9A is a perspective view of an alternate embodiment modular container with the components positioned for resealing.
Figure 9B:
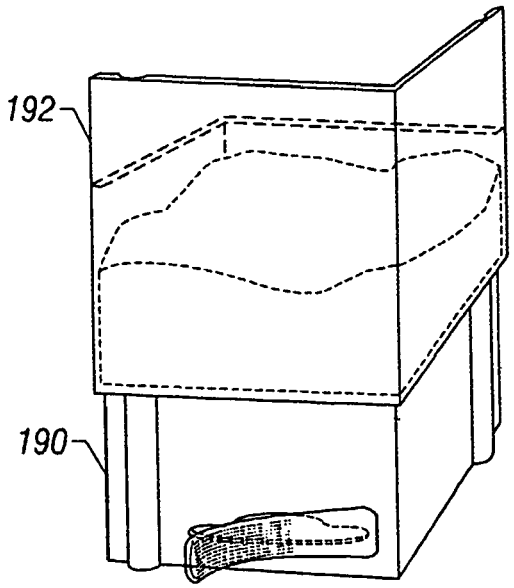
FIG. 9B is a perspective view of the container of FIG. 9A with the components positioned for food dispensing.

FIG. 9A illustrates another alternative embodiment in which the two compartments are designed to snap together one on top of the other and vice versa. In FIG. 9A, lower compartment 190 is shown in a position above upper compartment 192. In this orientation, lower compartment 190 may be slipped down and snapped into place on upper compartment 192. When the compartments are snapped together in this manner, each serves to seal the other compartment's opening. The bottom of lower compartment 190 seals the top of upper compartment 192, and the extended wall of upper compartment 192 seals the second opening in lower compartment 190. As shown in FIG. 9B, the two compartments are snapped together with lower compartment 190 underneath upper compartment 192, thereby exposing both food access points for the dispensing of food. Alternatively, the compartments may be snapped together such that the second opening in the lower compartment is underneath one of the shorter side walls of the upper compartment.

Figure 12:
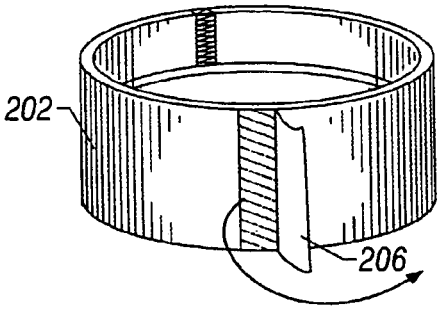
FIGS. 11 & 12 are perspective views of alternate embodiment rotary sleeves for rotating the container of FIG. 1.
Figure 11:
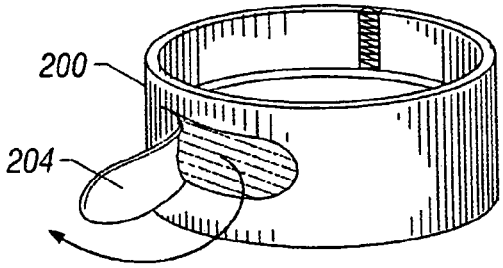

FIGS. 11 & 12 show examples of sleeves that may be used for sealing the second opening in the lower compartment of a container. Sleeve 200 in FIG. 11 has grip 204 to assist in rotating the sleeve around a container. Likewise, sleeve 202 in FIG. 12 has grip 206 to assist in rotating the sleeve around a container.

Figure 13A:
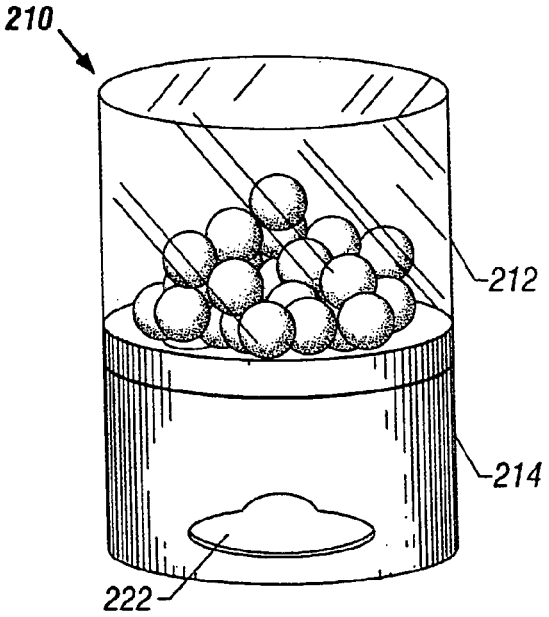
FIG. 13A is a perspective view of an alternate embodiment container for dispensing food with a more rounded shape.
Figure 13B:
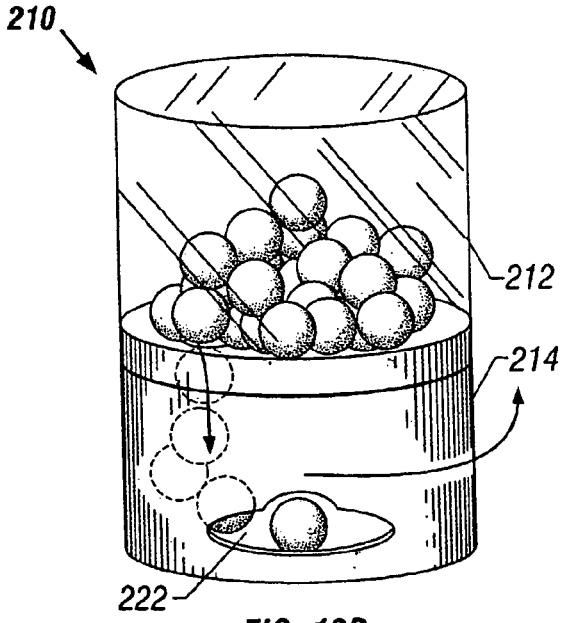
FIG. 13B is a perspective view of the container of FIG. 13A illustrating the functioning of the dispenser mechanism.
Figure 13C:
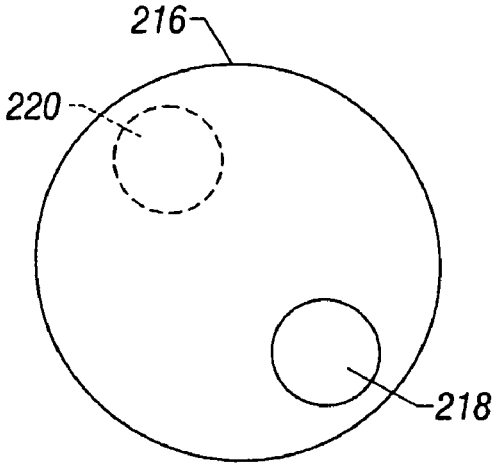
FIG. 13C is a plan view of the dispensing holes of the container of FIG. 13C.

Referring now to FIGS. 13A and 13B, there is shown an alternate embodiment lower compartment 210 utilizing a gumball-type dispenser that may be used for pellet-type food products. In this embodiment, top section 212 of the compartment is rotative with respect to bottom section 214. The two compartments are separated by a floor in the top section and a ceiling in the lower section, a plan view of which is shown in FIG. 13C as divider 216. The food product is normally stored in the top section 212, and it is dispensed into the bottom section 214 when the consumer rotates the two sections with respect to each other. As the two sections rotate, the hole 218 in the floor aligns with the hole 220 in the ceiling and pellets of food are able to pass from the top section to the bottom section. When the holes are aligned, second opening 222 is covered by the sleeve so that no food product may come out. After enough pellets have dropped through the opening, the consumer may then rotate the two sections until the holes are not aligned, and the second opening and sleeve opening are aligned so that food may be removed from the container. Alternatively, both the holes and the second opening & sleeve may be aligned at the same time. The hole alignment mechanism and the second opening/sleeve alignment mechanism may operate independently or may be couple together. As yet another alternative, only a small portion of the interior of bottom section 214 is open, enabling a pre-measured portion of food to be dispensed.

Pellet type products include nuts, puffed products, candies, small peanuts or the like. This compartment may be used separately, from another compartment, although it is preferable to couple it to another compartment, containing, for example, a beverage. Alternatively, more than one of these compartments may be connected together or to a beverage compartment.

Figure 14:
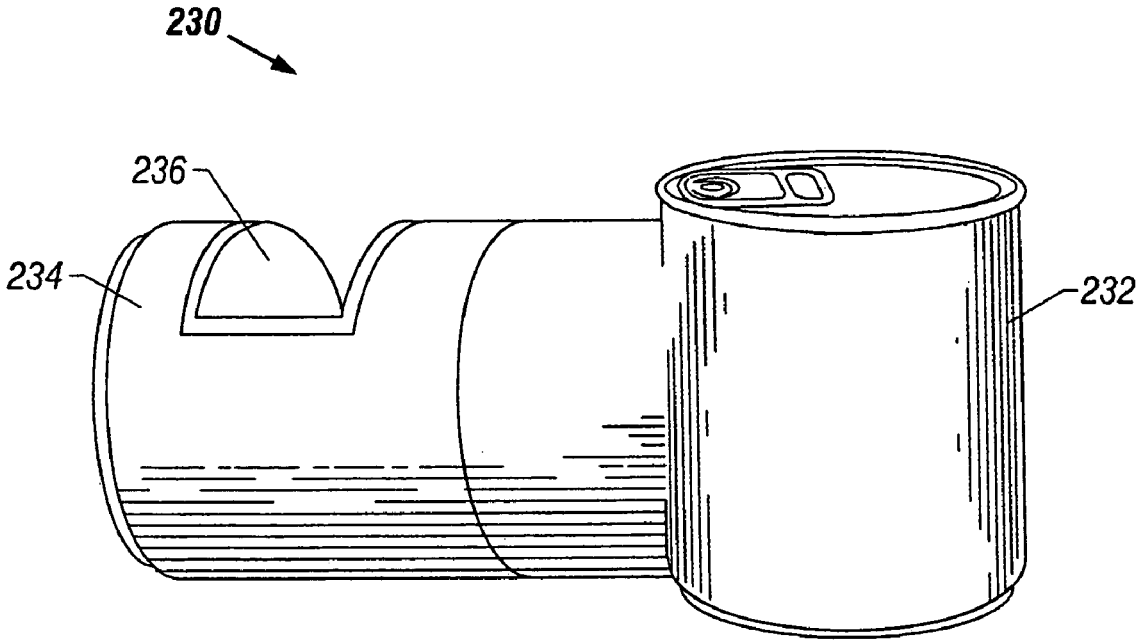
FIG. 14 is a perspective view of an alternate embodiment container for dispensing multiple food products.

Referring now to FIG. 14, there is shown another alternative embodiment container 230 in which the compartments are arranged horizontally with respect to each other instead of vertically. This embodiment accommodates food products that may not stack well and may not feed easily through the gumball dispenser of FIG. 13, although any type of food product may be used in this embodiment. Wet food product compartment 232 is oriented so that it is accessed from the top. Dry food product compartment 234 is horizontally connected to wet compartment 232, and is oriented so that an opening 236 is accessible from the top at the other region of the container. As before, a flexible sleeve may be used to reseal second opening or opening 236, and a lid may be used to seal the top of the wet compartment 232. The lid may be stored on the bottom region of compartment 232 while the container is being used. The various alternatives described hereinabove also apply to this embodiment. For example, in one alternative it may be preferable for dry food product compartment 234 to have a rectangular shape to facilitate connecting it to wet food compartment 232, or it may have a concave surface that aligns with the curved surface of wet food compartment 232.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of forming a multiple-food container, said method comprising:

forming a first section having a first compartment, and having a first opening at a top of said first section;

at least partially filling said first compartment with a first food;

sealing said first opening at said top of said first compartment with a removable lid;

forming a second section having a second compartment;

forming a second opening having a moveable seal on a side of said second compartment and proximate a bottom of said second compartment;

at least partially filling said second compartment with a second food;

sealing said second compartment; and coupling a top of said second section to a bottom of said first section.

2. The method of claim 1, further comprising forming interlocking modular connections at said top of said second section and said bottom of said second section prior to said coupling of said sections.

3. The method of claim 2, wherein said modular connections are separable.

4. The method of claim 1, further comprising attaching a resealing lid to said top of said first section after said sealing of said first opening.

5. The method of claim 1, further comprising forming a rotative resealing sleeve surrounding said second section.

6. The method of claim 1, further comprising forming said first and second sections into cylindrical shapes.

7. A method of forming a multiple-compartment container for food, said method comprising:

forming a first section having a first compartment and having a first opening at a top of said first section;

providing a removable lid adapted to cover said first opening at said top of said first section;

forming a second section having a second compartment and having a second opening on a side of said second compartment and proximate to a bottom of said second compartment to provide access to an interior of said second compartment;

forming a movable seal adapted to cover said second opening; and coupling said second section to said first section.

8. The method of claim 7, further comprising:

at least partially filling said first compartment with a first food;

sealing said first opening at said top of said first section with said removable lid;

at least partially filling said second compartment with a second food; and sealing said second compartment with said movable seal.

9. The method of claim 7, wherein said providing of said removable lid comprises removably and replaceably attaching said removable lid to said top of said first section.

10. The method of claim 7, wherein said coupling of said second section to said first section comprises removably snapping together said second section to said first section via interlocking connections.

11. The method of claim 7, wherein said coupling of said second section to said first section comprises permanently coupling said second section to said first section.

12. The method of claim 7, wherein said movable seal comprises a rotatable resealing sleeve surrounding said second compartment.

13. The method of claim 7, wherein said movable seal comprises a flap.

14. A method of forming a multiple-food container, said method comprising:

providing a first section of said multiple-food container, said first section having a first compartment at least partially filled with a first food, said first section having a first opening at a top of said first section, said first opening being sealed with a first cover;

providing a second section of said multiple-food container, said second section having a second compartment at least partially filled with a second food, said second section having a second opening having a moveable seal on a side of said second compartment and proximate to a bottom of said second compartment; and attaching said second section to said first section to form said multiple-food container.

15. The method of claim 14, wherein said providing of said first section comprises obtaining said first section after said first section is made by another.

16. The method of claim 15, wherein said first section is a beverage can and said first food is a beverage.

17. The method of claim 16, wherein said attaching said second section to said first section comprises:

inserting said beverage can into a modular adapter; and snapping together said modular adapter with said second section.

18. The method of claim 14, wherein said providing of said first section comprises:

filling said first compartment with said first food; and sealing said first opening at said top of said first section with said first cover.

19. The method of claim 18, wherein said providing of said first section further comprises forming said first section such that said first section has said first compartment with said first opening.

20. The method of claim 14, wherein said providing of said second section comprises:

filling said second compartment with said second food; and sealing said second compartment.

21. The method of claim 20, wherein said providing of said second section further comprises forming said second section such that said second section has said second compartment with said second opening and said moveable seal.

* * * * *